US008770125B2

(12) United States Patent
Guerrier

(10) Patent No.: US 8,770,125 B2
(45) Date of Patent: Jul. 8, 2014

(54) FLOATING SUPPORT OR VESSEL EQUIPPED WITH A DEVICE FOR DETECTING THE MOVEMENT OF THE FREE SURFACE OF A BODY OF LIQUID

(75) Inventor: Alain Guerrier, Plouhinec (FR)

(73) Assignee: Saipem S.A., Montigny le Bretonneux (FR)

( * ) Notice: Subject to any disclaimer, the term of this patent is extended or adjusted under 35 U.S.C. 154(b) by 275 days.

(21) Appl. No.: 13/320,487

(22) PCT Filed: May 7, 2010

(86) PCT No.: PCT/FR2010/050881

§ 371 (c)(1),
(2), (4) Date: Jan. 4, 2012

(87) PCT Pub. No.: WO2010/130925

PCT Pub. Date: Nov. 18, 2010

(65) Prior Publication Data

US 2012/0097088 A1 Apr. 26, 2012

(30) Foreign Application Priority Data

May 14, 2009 (FR) ..... 09 53202

(51) Int. Cl.

| | |
|---|---|
| ***B63B 25/08*** | (2006.01) |
| ***B63B 3/08*** | (2006.01) |
| ***B63B 9/00*** | (2006.01) |
| ***B63B 9/04*** | (2006.01) |

(52) U.S. Cl.
USPC ..... 114/74 R

(58) Field of Classification Search
USPC ..... 114/256–267, 72–75, 125
See application file for complete search history.

(56) References Cited

U.S. PATENT DOCUMENTS

| | | | | |
|---|---|---|---|---|
| 4,196,621 | A * | 4/1980 | Beese et al. | 73/861.22 |
| 6,301,572 | B1 | 10/2001 | Harrison | |
| 6,339,996 | B1 | 1/2002 | Campbell | |
| 7,540,200 | B2 * | 6/2009 | Yung et al. | 73/807 |
| 2002/0035957 | A1 | 3/2002 | Fischer, III | |

FOREIGN PATENT DOCUMENTS

| | | |
|---|---|---|
| GB | 2362698 | 11/2001 |
| WO | WO2008/076168 | 6/2008 |
| WO | WO2008/133785 | 11/2008 |

OTHER PUBLICATIONS

International Search Report dated Jul. 28, 2010.

* cited by examiner

*Primary Examiner* — Daniel V Venne
(74) *Attorney, Agent, or Firm* — Cozen O'Connor

(57) ABSTRACT

A ship or floating support for transporting/storing liquid constituted by a liquefied having a plurality of beacon devices for detecting roughness of liquid within the tank, each beacon having a vibration sensor for measuring amplitude of the acceleration (g) as a function of time (t) of the vibratory movements of a wall on which the beacons are fastened, and an electronic calculation unit having a microprocessor and memory for processing a signal as measured by the vibration sensor, and a device for transmitting the signal to a supervisor or central unit.

17 Claims, 7 Drawing Sheets

FLOATING SUPPORT OR VESSEL EQUIPPED WITH A DEVICE FOR DETECTING THE MOVEMENT OF THE FREE SURFACE OF A BODY OF LIQUID

PRIORITY CLAIM

This is a U.S. national stage of application No. PCT/FR2010/050881, filed on May 7, 2010. Priority is claimed on the following application: France Application No.: 0953202 Filed on May 14, 2009, the content of which is incorporated here by reference.

BACKGROUND OF THE INVENTION

The present invention relates to a ship or floating support for transporting or storing liquid in bulk, and fitted with one or more devices for detecting movements of the liquid free surface within the tank(s) of the bulk storage or transport ship.

More particularly, the invention relates to cryogenic transport ships for transporting either liquefied natural gas (LNG) or liquid methane, or else other gases that are maintained in the liquid state at very low temperature, such as propane, butane, ethylene, or any other gas of density in the liquefied state that is lower than the density of water, and that is transported in very large quantities in the liquid state and substantially at atmospheric pressure.

Liquefied gases that are transported at a pressure close to atmospheric pressure need to be cooled to a lower temperature in order to remain in the liquid state. They are then stored in very large tanks that are either spherical, or cylindrical, preferably presenting a cross-section that is polygonal, and in particular tanks that are substantially in the form of rectangular parallelepipeds, said tanks being very thoroughly insulated thermally in order to limit the evaporation of the gas and in order to maintain the steel of the structure of the ship at an acceptable temperature. As a general rule, such ships travel either when fully loaded (95%-98%), or else with a small residue of gas in the bottoms of the tanks (3%-5%) so as to keep the tanks and the insulation system permanently cold, thereby enabling them to be refilled more quickly, and thus avoiding any need to bring the tank down to a low temperature progressively, i.e. slowly, and thus consuming operating time.

Such ships are extremely difficult to operate because of the dangers associated with the gas and the associated risks of explosion. Thus, all of the technical equipment present on board needs to comply with extremely strict standards since the slightest spark runs the risk of leading to deflagration, and such a spark could be created by an impact between pieces made of metal, merely by a switch, or indeed by radio transmission at a power level exceeding a given threshold. All of those restrictions are the subject of very strict standards and equipment must comply with the conditions laid down in the ATEX standards, i.e. explosive atmosphere standards that are known to the person skilled in the art.

On a voyage, the contents of the tanks behave like liquids with free surfaces, and breaking swell type phenomena, known as "sloshing", can appear within the tank and can become very violent, in particular when waves break against the vertical walls of the tank, and also in particular when they break in the trihedron formed by the junction between two vertical walls and the ceiling of said tank. Such phenomena are particularly sensitive to the fact that the liquids concerned present viscosities that are very low, less than that of water.

These phenomena run the risk of appearing on methane tanker ships and also on anchored storage ships known as floating production storage and offloading (FPSO) ships, not only when sea conditions are rough, but even when the sea is almost smooth, in the event of the liquefied gas cargo entering into resonance with the excitation that is created by the swell to which the ship is subjected, even if the excitation is of small amplitude. In the event of resonance, sloshing can become very violent, and when waves break against the vertical walls or in the corners, there is a risk of damaging the system for confining the liquefied gas, or of damaging the insulation system that is present immediately behind said confinement system.

Sloshing phenomena can occur even under sea conditions that are relatively calm, but in general they appear only at very particular filling levels, with each combined state of significant amplitude of swell, period, angle of incidence, ballasting of the ship, . . . running the risk of becoming dangerous when a tank is at some particular filling level.

Thus, the problem of the present invention is to predict sloshing type phenomena of swell waves breaking within the tanks of ships for transporting or storing liquefied gas, in particular liquid methane or "LNG", by detecting the phenomena that occur prior to the appearance of said sloshing. In the description below, the term "LNG" is used to designate methane in the liquid state, i.e. liquefied natural gas, while the gaseous state is referred to as "methane" or as "gaseous methane".

Revealing the presence of these phenomena that occur before the appearance of such sloshing then enables the captain of the ship to modify the behavior of the ship, where appropriate, e.g. by changing its heading or its speed, so as to attenuate the resonance effects that might lead to sloshing that is damaging to the integrity of the ship. In the same manner, for ships that are fitted with means for statically or dynamically attenuating sloshing, e.g. external fins or active ballast systems, or indeed attenuation means that are incorporated directly in the tanks of said ship, revealing the presence of sloshing-precursor phenomena makes it possible to modify and adjust the settings of said systems finely in order to attenuate or even eliminate the unwanted phenomena.

The inventors have tried various devices for detecting movements of the liquid free surfaces inside storage tanks of ships or floating supports, but the sensitivity of such devices leads to information that is not of any use, in particular when using detector devices based on measuring the free area of the inside walls of a tank containing said liquid free surface, using sonars or ultrasound devices.

The problem of such detection results from the free surface of LNG being difficult to detect because of extremely low temperature conditions, and furthermore, in order to be able to analyze the free surface properly in zones that are critical for deducing the risks of essentially damaging sloshing occurring, it would be necessary to install too great a number of detectors.

According to the present invention, the inventors have implemented devices for detecting the movements of the liquid free surface, which devices are appropriate for those circumstances, and are based in particular on the principle of sensors for sensing vibration of a wall that is in direct or indirect contact with said liquid free surface, i.e. a wall to which the vibration of the walls of the tank is transmitted, detection preferably taking place with the help of vibratory accelerometers that measure variation in acceleration g as a function of time.

SUMMARY OF THE INVENTION

More precisely, the invention provides a ship or floating support for transporting or storing liquid constituted by a liquefied gas, preferably selected from methane, ethylene, propane, and butane, cooled in at least one large tank, preferably a cylindrical tank of polygonal cross-section, that is thermally insulated and of large size, with at least its smallest dimension in the horizontal direction, in particular its width, being greater than 20 meters (m), preferably lying in the range 25 m to 50 m, and a volume greater than 10,000 cubic meters ($m^3$), said large tank being supported inside the hull of the ship by a carrier structure, the ship being characterized in that it includes a plurality of devices for detecting the roughness of the liquid within said large tank(s), said devices being referred to below as "beacons", and comprising:

a) a vibration sensor of the vibratory accelerometer type suitable for measuring the amplitude of the acceleration (g) as a function of time (t) of the vibratory movements of a wall of said large tank or of a wall of the ship that is not in contact with sea water, said wall of the ship including the deck of the ship or a wall of the internal structure of the ship, preferably a wall of a portion of the internal structure supporting said large tank, said sensors being fastened on said wall outside said large tank; and b) an electronic calculation unit having a microprocessor and an incorporated memory, suitable for processing said signal as measured by said vibration sensor in order at least to eliminate therefrom background noise that is specific to the ship, and to detect the movement of the liquid inside said large tank by comparing values of the signal as processed in this way with predetermined threshold values beyond which the roughness of the liquid free surface is considered as constituting a risk of harmfully deforming and damaging said wall; and c) data transmission means for transmitting said signal, preferably after it has been processed by said electronic calculation unit to a supervisor or central unit, preferably on the bridge of the ship.

The term "wall of the internal structure of the ship" is used to mean in particular an internal wall of the hull of a double-hull ship or a wall of a system for supporting and/or insulating said large tank inside the hull.

Once the various items of signal data from the various beacons have been collected in said central unit, the person skilled in the art can input the data into a mathematical model that delivers recommendations concerning the behavior of the ship and/or the filling level(s) of the tank(s), said recommendations being designed to reduce or eliminate any risk of sloshing appearing, i.e. any risk of damaging deformation or deterioration of a said wall. The recommendations relate in particular to the speed and direction in which the ship should be sailed when it is a transport ship, and recommendations concerning the levels to which its tanks should be filled when the ship is a storage ship, as explained below.

More precisely, each said beacon comprises:

a said electronic calculation unit suitable for performing the following signal-processing steps consisting in:

1.1) using a Fourier transform, preferably of the FFT type in real time to process the signals of said variation in the amplitude of acceleration (g) as a function of time (t) of a said wall as measured by said vibratory accelerometer in step a) in order to calculate the variation in the amplitude of acceleration (g) as a function of the frequency F of the vibratory wave of the signal obtained in step a) over a given period of time $\Delta t$, and then preferably calculating the energy spectral density and/or the power spectral density;

1.2) filtering the signal to eliminate therefrom the background noise due to vibration that is specific to the ship; then 1.3) calculating maximum time acceleration values obtained by the inverse Fourier transform, preferably of the inverse fast Fourier transform (IFFT) type, of the variation of the amplitude of acceleration (g) as a function of frequency F as measured in step 1.1) and after filtering in step 1.2), and preferably calculating the values of the maximum energy spectral density and/or of the maximum power spectral density $P_0$ and also preferably calculating the spectral energy and spectral power values respectively of the energy spectral density measurements and/or a measurement of power spectral density performed in step 1.1) after filtering in step 1.2); and 1.4) comparing said maximum time acceleration values and preferably said maximum energy spectral density values and/or said maximum power spectral density values $P_0$ and also preferably said spectral energy and spectral power values respectively of step 1.3) with respective predetermined threshold values $S_1$, $e_{max}$, $p_{max}$ from which the roughness of the liquid free surface is considered as constituting a risk of damaging deformation or deterioration to said wall; and said transmission means suitable for being activated by said electronic calculation unit and for transmitting said maximum time acceleration values, and preferably said maximum energy spectral density values and/or maximum power spectral density values $P_0$ and more preferably said spectral energy and spectral power values respectively of step 1.3) are transmitted to a central unit preferably on the bridge of the ship, collecting the data transmitted by all of said beacons, which said values are transmitted to a said central unit, preferably on the bridge of the ship collecting the data transmitted by all of the beacons, if said threshold value of step 1.4) is reached by at least one of the beacons.

In steps 1.1) and 1.3), the calculations for converting the time signal by means of a Fourier transform and the spectral density and power calculations are known to the person skilled in the art of signal processing. Similarly, the spectral energy and spectral power calculations represented respectively by the integrals of the curves for energy spectral density and for power spectral density are likewise known to the person skilled in the art of signal processing.

In step 1.4), the risk of deforming or damaging said wall, associated with a said threshold value corresponds to a risk of a resonance phenomenon occurring in the movements of the liquid free surface.

By proceeding in this way, all of the real time calculations are performed by said calculation unit within the beacon, and only the results of the calculations are passed to the central supervisor, i.e. data that is more compact and that can be transmitted more quickly than a time signal that would otherwise occupy the transmission means full time, it being understood that the transmission means represent the major fraction of energy consumption of the beacon. Thus, the results of signal processing are transmitted only if the threshold values are exceeded.

In step 2), said transmission means that were initially on standby are activated by a command triggered by said calculation unit, in the event of a said threshold value being reached.

It can be understood that said calculation unit includes incorporated memory suitable for storing the data received from the sensors over time, thereby enabling the calculation unit to analyze the overall behavior of the free surface over time, in particular when the ship is either sheltered or else sailing in calm water, i.e. when there is no risk of causing the liquid free surface to move and thus no risk of sloshing, said observation being correlated with the roll and/or the pitching of the ship and serving to evaluate the background noise that is specific to the ship in the absence of significant movements of the liquid free surface, thus making it possible to define said above-mentioned thresholds.

More particularly, said vibratory accelerometer is an accelerometer of the piezo-resistive type.

Such piezo-resistive detection accelerometers are capable of picking up frequencies in the range 0 to 5-10 kilohertz (kHz) and they present measurement accuracy of the order of 3%-5%. This type of piezo-resistive detection accelerometer is capable of characterizing a total rest state, i.e. a state with zero acceleration.

Other types of vibratory accelerometer can be implemented, such as accelerometers making use of piezoelectric detection, capacitive detection, inductive detection, a strain gauge, amongst others.

Preferably, said vibration sensor is constituted by a three-axis vibratory accelerometer. Such three-axis accelerometers are suitable for measuring the amplitudes of vibration of the wall in three directions in space as a function of time.

Preferably, said transmission means comprise an antenna and a transceiver suitable for transforming the electrical signals supplied by said calculation unit into radio waves, which radio waves are transmitted from an antenna.

In another embodiment, said transmission means comprise wired transmission means, comprising cables connecting a signal processing interface suitable for making the signal suitable for being conveyed via said cables, preferably optical fiber cables combined with interfaces transforming said data from the electrical signal supplied by the electronic calculation unit into light signals.

In a first variant embodiment, a said beacon further includes an additional device suitable for detecting the movements specific to the ship and for triggering activation of said electronic calculation unit to perform the processing of said steps 1.1) to 1.3) and 2) by said beacon and the other electronic calculation units of the other beacons of the same tank and of the other tanks of the ship or floating support, the triggering of the activation of said electronic calculation units taking place from a predetermined threshold value for the amplitude of movements of the ship, preferably a value of the angle of inclination of a wall of the hull of the ship.

The additional device of the inclinometer or inertial unit type serves to detect the movements specific to the ship, such as roll, pitching, yaw, surge, sway, etc.

In another embodiment, a said beacon does not include any additional device for detecting the movements specific to the ship.

More particularly, said device for detecting movements of the ship is an inclinometer of the pendular type or an inertial unit, preferably suitable for determining the roll angle of a side wall of the hull of the ship or floating support, said threshold value being a roll angle of at least 5°, preferably lying in the range 5° to 10° relative to the vertical.

In the standby state, the device consumes very little energy, since within the calculation unit the standby unit remains very simple. In contrast, as soon as potentially critical conditions arise, the calculation unit then analyzes all of the information coming from the vibration sensor and performs signal processing, with the results of said processing then being transmitted to the central supervisor in the event of at least one of the predefined thresholds being exceeded.

When a beacon is activated by its own inclinometer, it is advantageous to activate the other beacons so as to be sure that all of the beacons are active. By acting in this way, there is a high level of redundancy for activating an entire system of beacons, since each beacon is normally activated by its own inclinometer and each informs all of the others as well as the central supervisor whenever it enters into action. Thus, the risk of having a beacon that remains on standby is very greatly restricted.

In both implementations for activating the electronic calculation unit as described above, the term "activating the electronic calculation unit" means that it was previously in a standby state and that it automatically activates itself so as to perform the processing and the transmission involved in above steps b) and c), said transmission means 5*d* being activated by said electronic calculation unit 5*b*.

In another embodiment, said electronic calculation unit is suitable for being activated from a measurement of a threshold value for the amplitude of acceleration (g) as a function of time.

Advantageously, each said beacon is powered by power supply means consisting in a storage battery or a supercapacitor, or preferably a lithium primary battery, powering said vibratory accelerometer, electronic calculation unit, and transmission means, and preferably said devices for detecting movements of the ship.

Also advantageously, said power supply means further include a Seebeck effect thermocouple in which the cold junction is installed between the cold internal wall of the tank and said beacon, the beacon constituting the hot junction of the thermocouple, said thermocouple serving to generate a current continuously for powering said beacon and preferably continuously recharging a said storage battery or supercapacitor.

In a preferred embodiment, said beacons are secured to the deck of the ship and/or to a side wall for supporting and insulating the walls of said large tank inside the hull of the ship facing a side wall of the hull, said beacons being situated in the proximity of corners of said large tank at its longitudinal ends.

According to other characteristics of said beacons:

said beacons are positioned facing a dihedral angle formed by the corners between a vertical longitudinal side wall, a vertical transverse wall, and a ceiling wall of said large tank or a trihedron formed by two planes of a ceiling wall of said large tank that are disposed angularly relative to each other, and a transverse vertical side wall of said large tank;

said beacons are fastened to a said wall by welding or by adhesive; and each of said beacons comprises a container serving to confine all of said vibration sensors, the electronic calculation unit, the signal data transmission means, and preferably the additional detector device, said container being fastened to said wall and to said power supply means.

Since the beacons are installed in a potentially explosive atmosphere, they need to satisfy strict standards known as ATEX standards. These standards define precise constructional arrangements in terms of electrical circuits, sealed containers, power levels for transmission from a radio antenna, etc. . . . , for ensuring that no spark appears that runs the risk of igniting a gaseous environment, and thus of creating an explosion.

In a particularly advantageous embodiment, said ship is an old methane tanker type transport ship converted into a floating storage ship that is anchored at a fixed location, in which the filling level of at least one of its tanks is determined as a function of the roughness of the liquid it contains, as detected and calculated by a said device for detecting liquid roughness.

The present invention also provides a method of detecting roughness of the liquid within one or more tanks of a ship of the invention, the method comprising the following successive steps:

1) performing said signal processing, preferably after activating a said electronic calculation unit when the movement of the ship reaches a threshold value; and 2) performing said transmission of values obtained in step 1) from said electronic calculation unit to a said central unit.

BRIEF DESCRIPTION OF THE DRAWINGS

Other characteristics and advantages of the present invention appear better on reading the following description made by way of non-limiting illustration and with reference to the accompanying drawings, in which.

DETAILED DESCRIPTION OF THE PRESENTLY PREFERRED EMBODIMENTS

Figure 1:
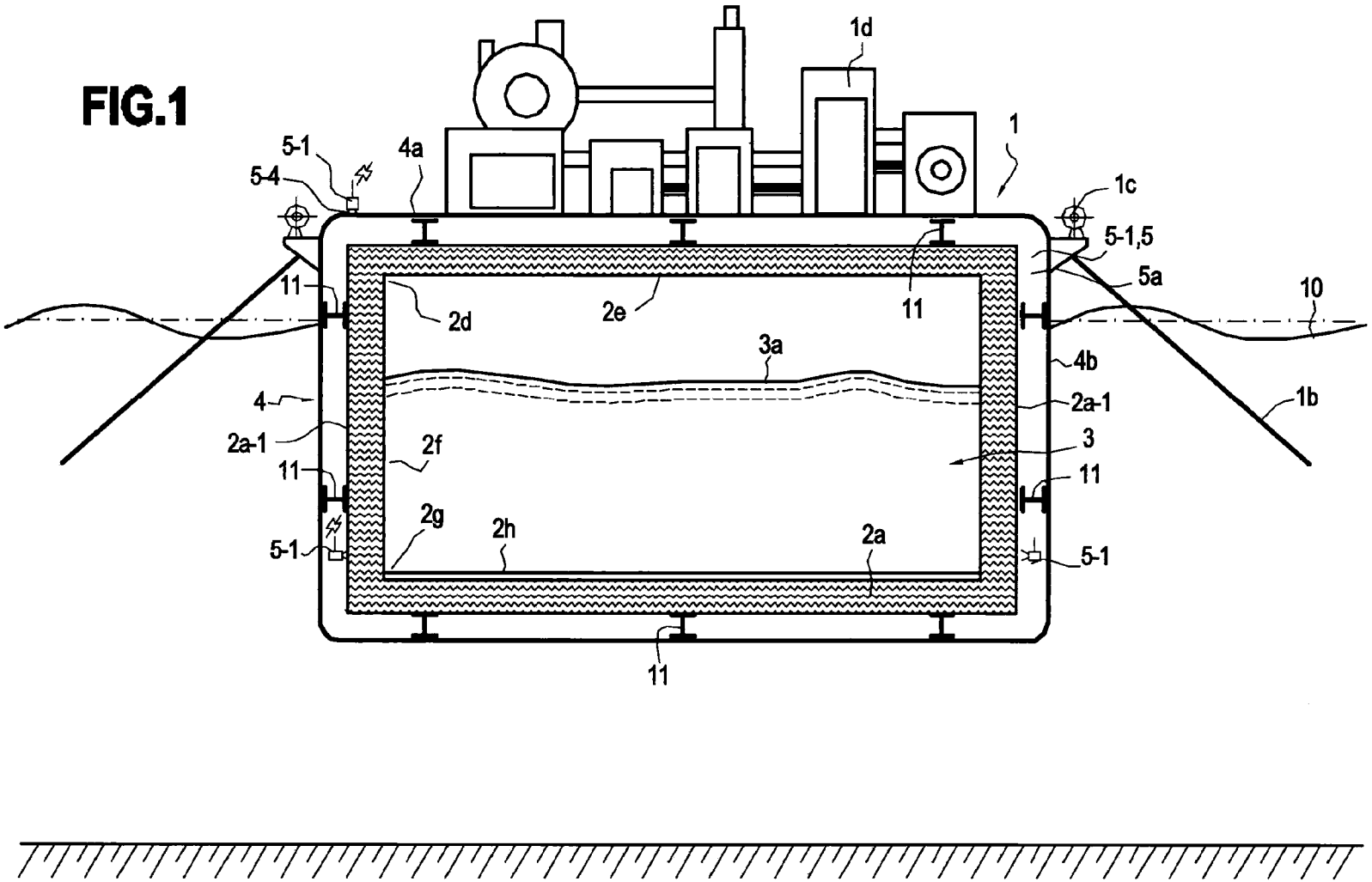
FIG. 1 is a cross-section and front view of a floating storage and regasification unit (FSRU) for storing and regasifying LNG and fitted with devices for detecting liquid free-surface movements within the tank 2 of said floating support that presents a vertical section that is rectangular.

FIG. 1 is a cross-section of an FSRU type ship 1 that is anchored by lines 1*b* connected to winches 1*c*, being installed over an oil field and receiving, via pipes (not shown), gas coming from undersea well heads, said gas being processed on board in installations id so as to be cooled to a temperature below −163° C. and stored in liquid form 3 in tanks 2 prior to being transferred to methane tankers that are used for transporting said gas, still in liquid form, to users. The tanks 2 are in the form of rectangular parallelepipeds presenting a volume of 24,000 $m^3$ having a width of 20 m, a length of 40 m, and a height of 30 m, and the largest tanks may reach or exceed 60,000 $m^3$. The ship is fitted with devices 5 for detecting liquid free-surface movements, also referred to below as "beacons" or indeed as "sloshing detector devices" of the invention, i.e. four wireless beacons 5-1 situated close to the corners of the tanks at the longitudinal ends of the tanks, respectively on the left or port, level with the deck 4*a* and low down inside the hull, in contact with the wall 2*a*-1 of the thermal insulation system 2*a* of the tank 2, and on the right or starboard, both high up and low down inside the hull, in contact with the wall 2*a*-1 of the thermal insulation system 2*a* of the tank 2.

More precisely, the beacons 5-1 are positioned in the proximity of:

dihedral-forming corners 2*d* where a longitudinal side wall 2*f* meets a transverse side wall 2*g*; and dihedral-forming bottom corners 2*g* where the bottom wall 2*h* meets a longitudinal side wall 2*f* and a transverse side wall 2*g* at the longitudinal end of the tank.

The tanks 2 are secured to the hull 4*a*, 4*b* via carrier structures 11 of the metal beam type that are uniformly distributed and that provide a connection firstly between the surfaces of the outside wall 2*a*-1 of the covering 2*a* of the tank 2 (itself secured to the walls 2*f*, 2*h* of the tank 2) and secondly to the inside walls of the hull of the ship.

The beacons close to the top corners 2*d* are positioned either on the deck 4*a* of the floating support, or else against a longitudinal side wall 2*a*-1 of the insulation system facing the side wall 4*b* of the hull of the ship.

The beacons situated close to the bottom corners 2*g* are preferably situated against a side wall 2*a*-1 of the insulation system 2*a* of the tank 2 inside the hull and facing its side wall 4*b*.

The operation of the beacons is described in greater detail below in the description of the invention.

The free surface 3*a* of the liquid methane (LNG) within the tank 2 is generally slightly rough as a function of the way the liquid free surface is excited by the swell, the wind, and the current acting on the ship. Under poor sea-and-weather conditions, this roughness can increase and lead to large waves being reflected on the walls of the tank and can lead to waves breaking against said walls.

When sailing or when anchored, the ship is subjected to sea conditions, i.e. swell, current, and wind, and the content of the various tanks is therefore subjected to continuous excitation from said swell, said current, and said wind. This causes a kind of confined swell to form within the tank 2, which swell rebounds against the side walls 2*f* and is therefore reflected while retaining its own energy, i.e. its period and its amplitude. As a result, the surface is rough to a greater or lesser extent depending on sea conditions. Swell as reflected in this way against the walls recombines and may then tend towards states of decreasing roughness when recombination takes place with a phase offset, or towards states of increasing roughness when recombination takes place in phase.

Thus, when the ship 1 is subjected to external swell 10, whether coming from the high seas, or due to wind or to currents, the roll, pitch, yaw, sway, heave, and surge movements of the ship excite the liquid free surface contained in the tank 2 and resonance phenomena can then occur within said tank, as a result of the way in which the above-described multiple reflections against the walls of the tanks combine.

These phenomena can be violent and lead to a risk of damage to the system for retaining and confining the liquefied gas. These phenomena do not occur in stormy weather only, but can also occur even in moderate weather, should certain parameters associated with the behavior of the ship, the shape of its tanks, and the level to which said tanks are filled, all occur together.

For example, a transverse swell of low amplitude, e.g. having a significant height Hs=1.25 m, associated with particular periods, e.g. T=8 seconds (s) to 10 s, presents no danger when the tanks are full or empty, or indeed at intermediate filling levels, but at some precise value, e.g. 70% to 80% full, resonance phenomena will appear under such particular conditions, leading to the liquid gas cargo behaving dangerously in a manner that might lead to swell breaking very violently in resonance against the walls of the tank. Such breakers can then lead to damage or even to destruction of the confinement or insulation system, thereby putting the ship and its entire crew in great danger.

The strongest movements and turbulence tend to accumulate in the vertical corners at the longitudinal ends of the tanks, and more particularly the severest impacts are created in the trihedrons created by the ceiling of the tank together with two vertical side walls, a transverse wall and a lateral wall.

The vertical corners 2*d* at the ceilings of the tanks constitute zones where, when breaking does take place, there is a risk of very violent impacts occurring because of the trihedron shape defined by the two vertical walls and the ceiling of the tank, which is why the beacons 5-1, 5-2 are advantageously placed in the proximity of said corners of the tanks.

Figure 2:
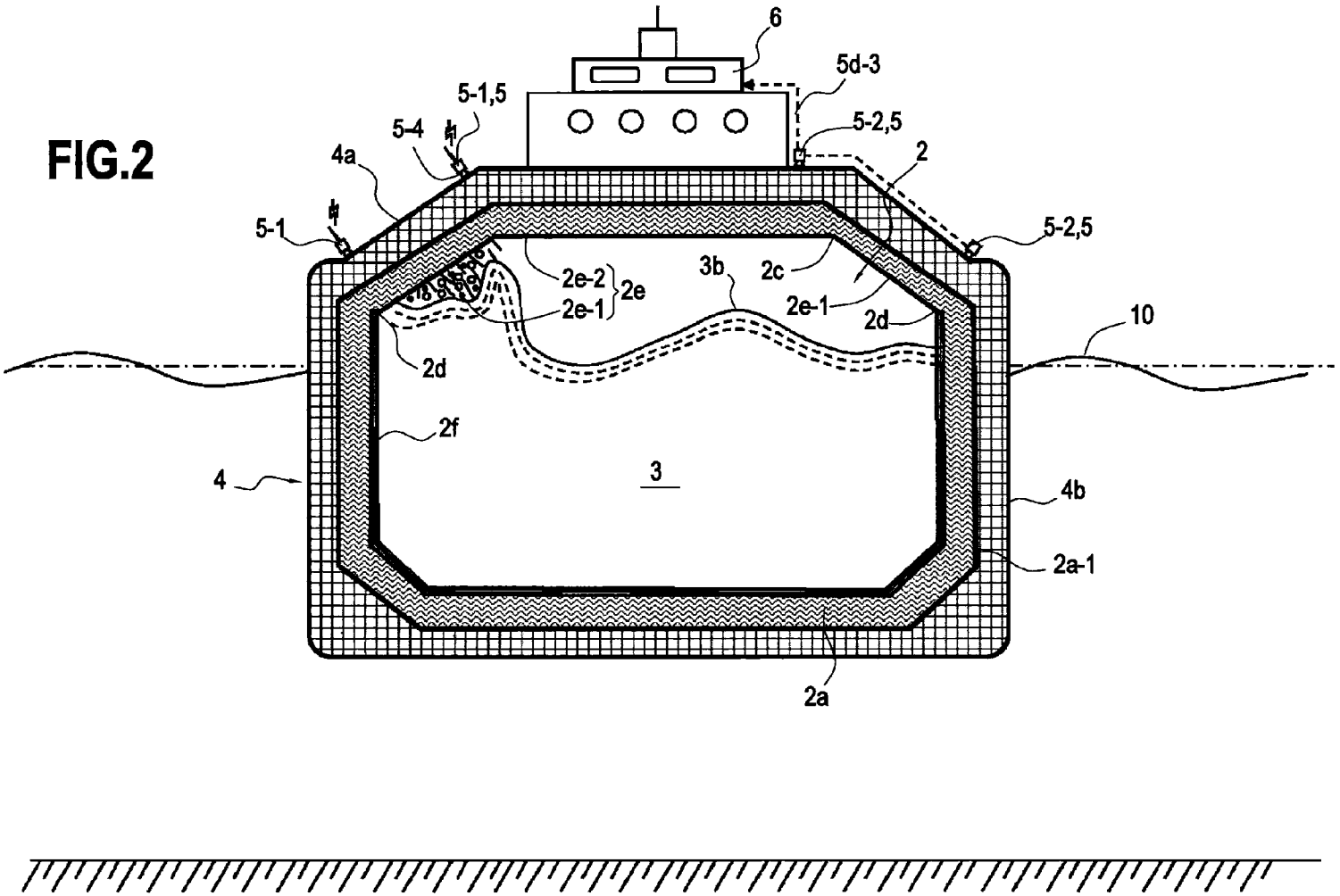
FIG. 2 is a cross-section and front view of an LNG tanker ship fitted with devices for detecting liquid free-surface movements within the tank 2 of said ship, which tank is of octagonal section.

FIG. 2 is a cross-section through another ship 1, here of the methane tanker type, that is fitted with liquid free-surface movement or sloshing detector devices 5-1, 5-2 of the invention, with the sloshing phenomenon here being shown at 3*b*, ready to break against the top of the port portion 2*f* of the LNG tank.

On the left, to port, two wireless type beacons 5-1 are installed on the deck 1*a* of the ship, these beacons communicating by radio with a central supervisor 6, preferably a personal computer (PC) type computer, that is installed in the control station, preferably on the bridge of the ship, with these beacons also communicating by radio with the other beacons 5-1, as explained below. On the right, to starboard, two wired type beacons 5-2 are installed on the deck 1*a* of the ship, these beacons communicating with the same central supervisor 6 via a computer local network 5*d*-3.

More particularly, the tank 2 of the ship presents an octagonal section with a ceiling wall made up of a horizontal central wall 2*e*-2 and two sloping side ceiling walls 2*e*-1 going down towards the longitudinal side walls 2*f*.

These tanks thus present corners of trihedron shape at their longitudinal ends, i.e.:

first trihedrons 2*d* formed by a longitudinal side wall 2*f*, an end transverse wall 2*g*, and the adjacent sloping ceiling wall portion 2*e*-1; and trihedrons 2*c* formed by an end transverse wall 2*g* and by two adjacent ceiling walls 2*e*-1, 2*e*-2 that are arranged at an angle relative to each other.

Figures 7A, 7B, 8A, 8B, 9A, 9B, 10A, 10B:
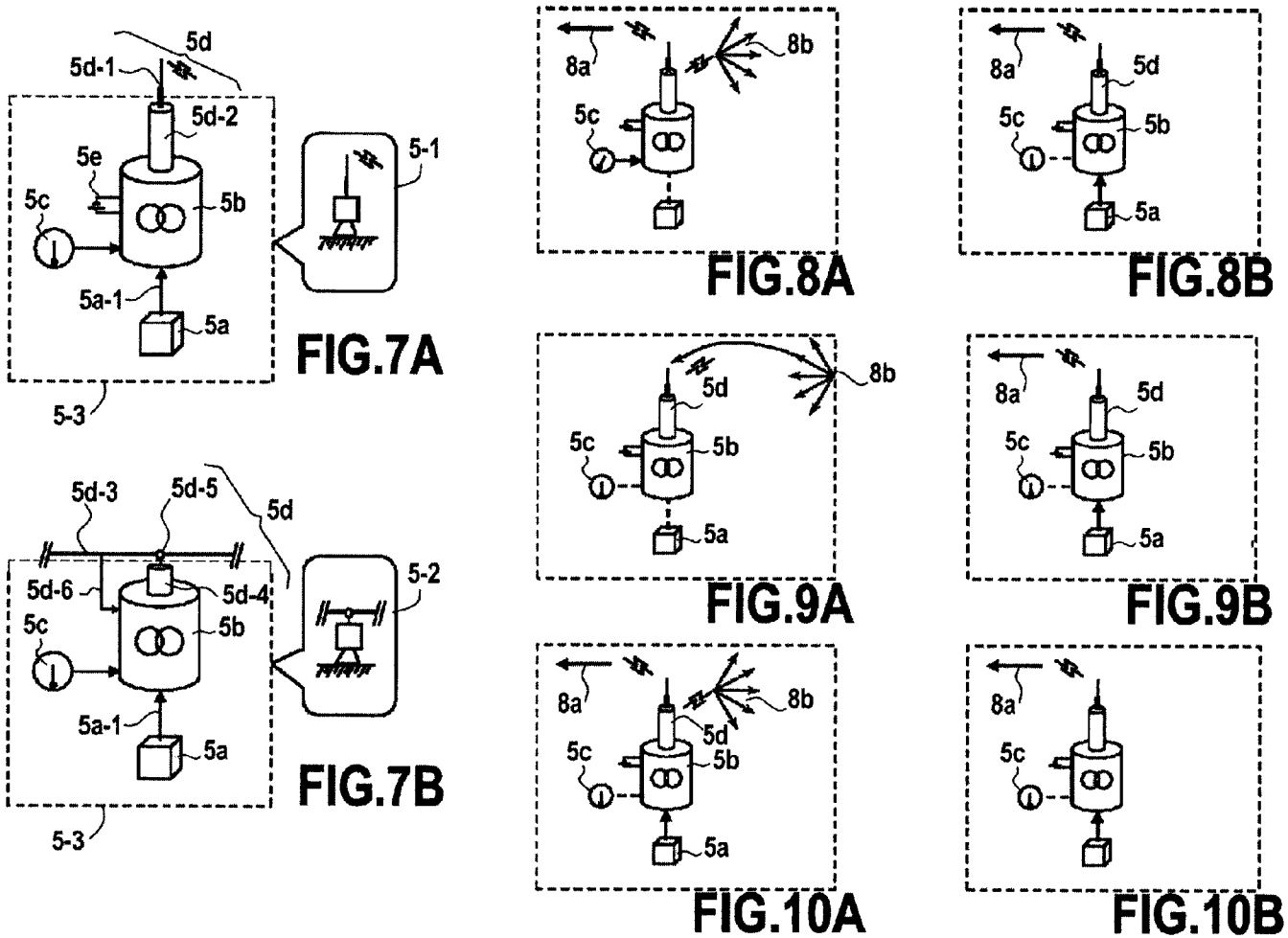
FIGS. 7A and 7B show details of the operation of "sloshing" detection devices respectively in a wireless version (7A) and in a version that is connected to a wired local network (7B)
FIGS. 8A and 8B show a mode of liquid free-surface movements, or "beacon", based on information associated with the ship's own movements.
FIGS. 9A and 9B show a mode of triggering liquid free-surface movement detection devices on the basis of information associated with triggering a said device for detecting any liquid free-surface movements.
FIGS. 10A and 10B show a mode of triggering a device for detecting liquid free-surface movements on the basis of information associated with the appearance of a phenomenon of the liquid free-surface movement type.

As shown in detail in FIGS. 7A and 7B, the beacons 5-1 and 5-2 are constituted by the following elements:

a) a vibration sensor 5*a* consisting in a vibratory accelerometer, more precisely an accelerometer capable of measuring the variations as a function of time in the accelerations g of the vibrations of the wall against which they are fastened. These vibrations of the wall of the deck 1*a* on which they are fastened are associated with the vibrations of the walls of the tank 2, since it is supported by the hull of the ship or the floating support and is securely fastened thereto by a carrier structure 11, which structure transmits vibration from the tank 2 to the hull 1*a*-1*e* of the ship; more precisely, these accelerometers are three-axis accelerometers known to the person skilled in the art, i.e. they are suitable for measuring linear acceleration in three directions in space, and they are preferably accelerometers of the piezo-resistive type, capable of measuring acceleration over a range extending from zero to a maximum value. In order to pick up vibration in the most faithful manner, these beacons 5*a* are fastened against the walls to which they are fastened by welding or by adhesive;

b) an electronic calculation unit 5*b* comprising a microprocessor and incorporated memory; and c) data transmission means 5*d*, which may be of two types:

wireless beacons 5-1; or wired beacons 5-2.

With wireless beacons 5-1, said transmission means comprise an antenna 5*d*-1 and a transceiver 5*d*-2 suitable for transforming the electrical signals provided by said calculation unit 5*b* into radio waves, which radio waves are transmitted from an antenna 5*d*-1.

With wired beacons 5-2, said transmission means 5*d* comprise cables 5*d*-3 connecting a signal-processing interface 5*d*-4 suitable for making the signal suitable for being conveyed via said cables 5*d*-3, preferably optical fiber cables, combined with interfaces 5*d*-4 that transform said data of the electrical signal delivered by the electronic calculation unit 5*b* into light signals.

In a variant embodiment, the beacons 5-1, 5-2 include a device for detecting movements of the ship 5*c*, in the form of an inclinometer, e.g. of pendular type, or an inertial unit, preferably suitable for determining the roll angle of a side wall 4*b* of the hull of the ship or of the floating support.

The device 5*c* is suitable for triggering activation of said electronic calculation unit 5*b* in order to perform the processing of said steps b.1) to b.3) and c) of said beacon and of other electronic calculation units 5*b* of other beacons of the same tank and of other tanks of the ship or the floating support, the triggering of the activation of said electronic calculation unit taking place from a predetermined threshold value for the amplitude of the movements of the ship, preferably a value for the angle of inclination of the wall of the hull of the ship, said threshold value being a roll angle of at least 5%, and preferably lying in the range 5% to 10% relative to the vertical.

Figure 3:
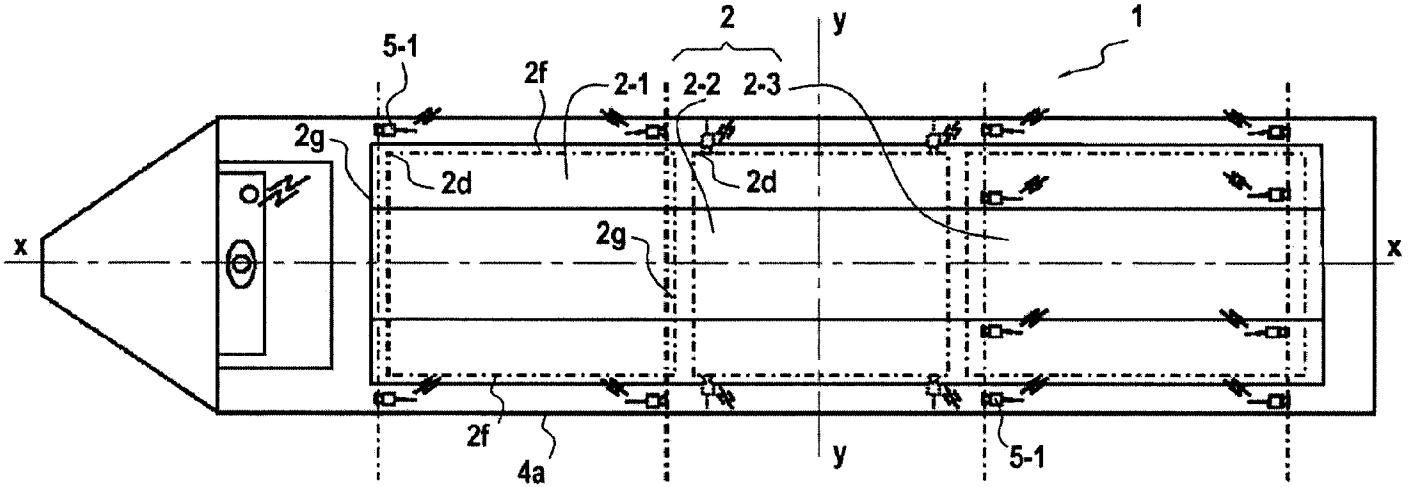
FIG. 3 is a plan view of an LNG tanker ship having three tanks fitted with devices for detecting liquid free-surface movements within said tanks.

FIG. 3 is a plan view of an LNG tanker ship having three tanks 2 1, 2 2, and 2 3 of octagonal section, the first tank 2 1, to the left, being fitted with four beacons 5 1 of the wireless type of the invention, that are installed outside on the deck of the ship, at the outer vertical corners 2*d* of said tank, at its longitudinal ends.

The middle tank 2-2 is also fitted with four beacons 5-1 installed inside the ship high up between the outer side wall 1*e* of the ship and the outer wall 2-1 of the insulation covering 2*a* of the LNG tank 2-2. Finally, the right tank 2-3 is fitted with eight devices 5-1 as in FIG. 2, situated respectively at the four corners 2*d*, on the outside, and at the four corners 2*c* where the sloping walls 2-1 of the ceiling join the central wall 2-2 of the ceiling of the tank, as shown in the section view of FIG. 2.

Figure 4A:
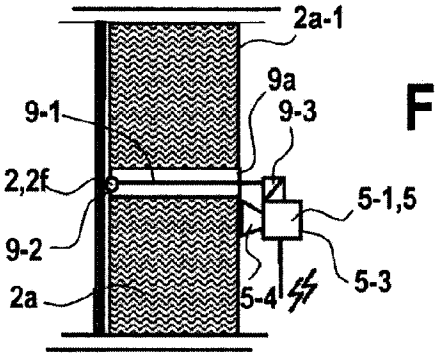
FIG. 4A shows a detail of the device of FIG. 4.
Figure 4:
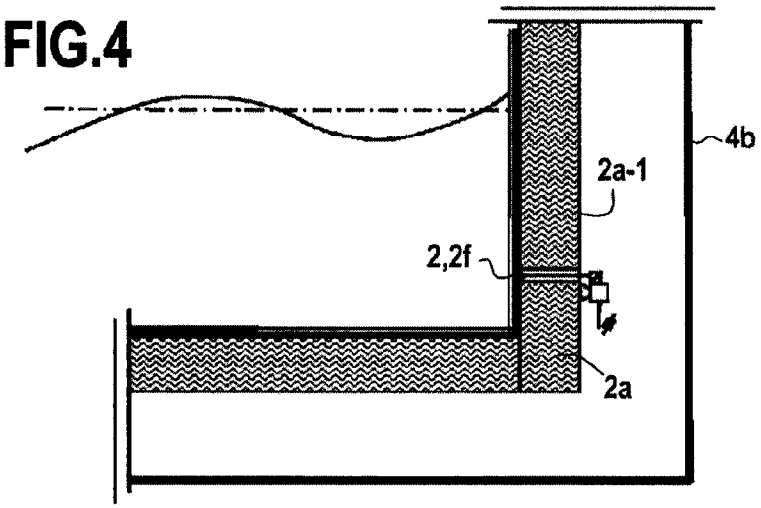
FIG. 4 is a cross-section in side view of the bottom portion of the tank fitted on the right-hand side with a liquid free surface detection device that is powered by a Seebeck effect thermocouple.

The devices for detecting liquid free-surface movements, or "beacons" 5-1, 5-2 are installed either directly in contact with the outside wall 4*a*, 4*b* of the ship, preferably at the level of the deck 4*a* of said ship as shown in FIG. 2, or inside the ship, e.g. in a gangway, in the space between the side wall 4*b* of the ship and the insulation covering 2*a* of the LNG tank, as shown in FIGS. 1 and 4-4A. In any event, the device 5-1, 5-2 for detecting liquid free-surface movements is secured to the wall on which it is installed. It is fastened either mechanically by welding 5-4 or by bolting, or indeed advantageously merely by adhesive, so that any vibration of said wall is transmitted in full to the device 5-1, 5-2 with a minimum of attenuation. Thus, the detection devices 5-1, 5-2 are so to speak "listening" to what is taking place inside the LNG storage tanks.

Figure 5:
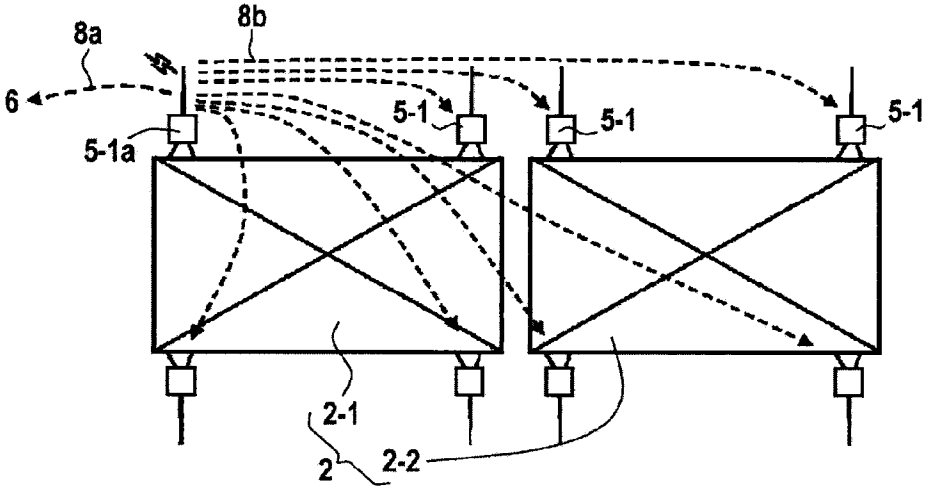
FIG. 5 is a plan view of two LNG tanks fitted with liquid free-surface movement detection devices of the radio transmission type.
Figure 6:
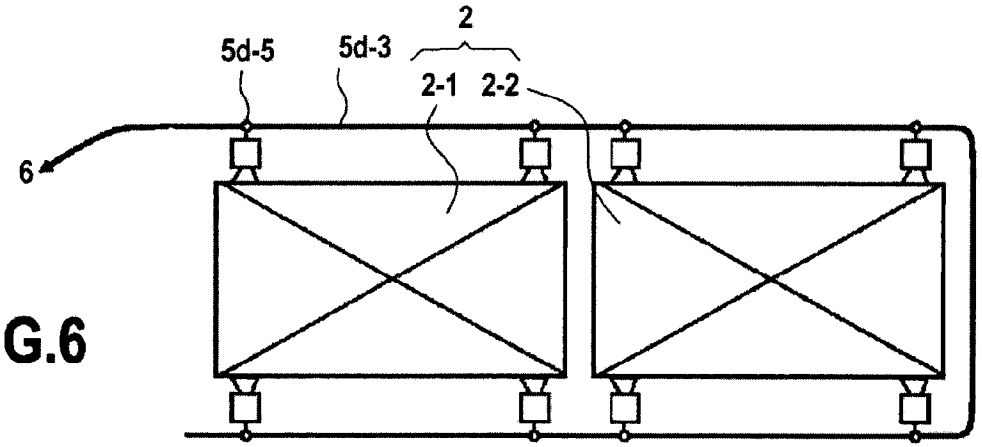
FIG. 6 is a plan view of two LNG tanks fitted with liquid free-surface movement detection devices that are connected to one another and to the bridge of the ship via a wired local network.

The sloshing detector device 5 is either of the wireless type 5-1, in which case it transmits its information by radio, as shown in FIGS. 5 and 7A, or else it is of the wired type 5-2, in which case it transmits its information, e.g. by means of a wired computer local network 5*d*-3, as shown in detail in FIGS. 6 and 7B.

In FIG. 7A, the sloshing detector device or "beacon" is of the wireless type 5-1. It is constituted by a three-axis accelerometer 5*a* connected at 5*a*-1 to a calculation unit 5*b*, the assembly being powered by a supercapacitor or a battery 5*e*, preferably a lithium primary battery having a very long lifetime. The information derived from calculations performed within the calculation unit 5*b* is transmitted by radio via a radio transceiver 5*d*-2 fitted with an antenna 5*d*-1.

In the wired beacon version 5-2, shown in FIG. 7B, the beacon is constituted by a three-axis accelerometer 5*a* connected to a calculation unit 5*b*, the namely being powered via 5*d*-6 by a network type wired connection 5*d*-3. The information that results from calculations performed within the calculation unit 5*b* is transmitted to the central unit 6.

FIG. 5 is a plan view of two tanks 2-1, 2-2 fitted at their four corners with wireless type beacons 5-1, and one of the beacons 5-1*a* has just been activated by the inclinometer device 5*c* and therefore communicates by radio with the central supervisor 6 and with all of the other beacons 5-1 of the two tanks in order to activate them.

In the same manner, FIG. 6 is a plan view of two tanks 2-1, 2-2 fitted at their four corners with beacons 5-2 of the wired type, communicating with the central supervisor 6 and with all of the other beacons via a local network 5*d*-3.

With both types of beacon, whether wireless 5-1 or wired 5-2, the mode of operation is the same. It is described in detail with reference to FIGS. 8, 9, and 10.

In the absence of any movements of the ship, all of the beacons are at rest, on standby, and consequently they consume very little energy, which is a considerable advantage for the battery-powered wireless beacons 5-1. When activated, each beacon communicates individually with the supervisor computer 6 that is preferably situated on the bridge, as shown in FIG. 1. Furthermore, said beacon simultaneously informs all of the other beacons and activates them, which beacons then put themselves in a mode for acquiring data, processing data, and communicating with the central supervisor 6.

In FIG. 8A, activation of a beacon is caused by the device 5*c*, of the inclinometer or inertial unit type that is responsive to the ship's own movements. A radio signal 8*a* is then sent to the central supervisor 6 and a radio signal 8*b* is sent to the set of beacons in order to activate them. Once a beacon is activated, the three-axis accelerometer 5*a* sends its data to the calculation unit 5*b* which processes it in a particular manner that is explained below, and then transmits the data that results from the processing of the signal by radio to the supervisor 6. Said supervisor 6 then processes all of the data picked up by the various beacons 5-1, 5-2 and is therefore in a position to determine the roughness state of the liquid free surface in the tank in order to determine whether said roughness is in danger of leading to sloshing that is damaging to the installations.

The supervisor 6 preferably enters the data picked up by the various beacons into a mathematical model enabling it to deliver piloting command recommendations for the ship in terms of speed and/or direction for reducing or eliminating this risk of sloshing.

In FIG. 9A, the activation of a calculation unit 5*b* of the beacon 5 is caused by a radio signal 8*b* coming directly from a first beacon or by a radio signal 8*c* coming from the central supervisor 6, after it has itself picked up data coming from said first beacon. The process of acquisition and transmission, as shown in FIG. 9B, is then identical to that described above with reference to FIG. 8B.

Finally, in FIG. 10A, a beacon is activated by a signal coming from its accelerometer 5*a*, which signal may be caused, for example, by a resonance phenomenon of the LNG liquid free surface when the ship's own movements are small or insignificant, said movements of the ship not being sufficient to reach the threshold for triggering the device 5*c* of the inclinometer or inertial unit type. The beacon then sends a signal 8*a* to the central supervisor 6 together with a signal 8*b* to all of the other beacons in order to activate them. The acquisition and transmission process as shown in FIG. 11B is then identical to that described above with reference to FIG. 9B.

For wired connections 5*d*-2, the same information as that described with reference to FIGS. 8, 9, and 10 that applies to radio connections passes in known manner over the wired local network 5*d*-3 that connects together all of the beacons and the central supervisor 6, in series, in a star configuration, or in a ring configuration.

The processing of the signal within a beacon 5 is shown diagrammatically in FIGS. 11 to 13.

In normal operation mode, i.e. not during self-training adjustment stages as described below, when the beacon is triggered, e.g. by rolling and/or pitching exceeding a given threshold, e.g. as perceived by the inclinometer 5*c*, the calculation unit is aware, merely by direct measurement of the signal, of the exact period of said rolling/pitching, and thus of the degree of risk of movements of the liquid free surface being excited and amplified so as to degenerate into sloshing, on the basis of mathematical models of liquid free surfaces within various tanks. On the basis of the time signal shown in FIG. 11A, associated with said excitation period, i.e. said rolling and/or pitching period, and using software incorporated in the calculation unit 5*b*, various types of processing are performed depending on the configuration of said signal.

Thus, an FFT serving to convert said time signal into a frequency signal g=f(Hz), in a manner that is known to the person skilled in the art of signal processing, is always performed and is well adapted to a pulse signal with little resonance, i.e. having few harmonic responses, which signal may be of large or small amplitude, but is preferably centered about a frequency.

Figure 11A:
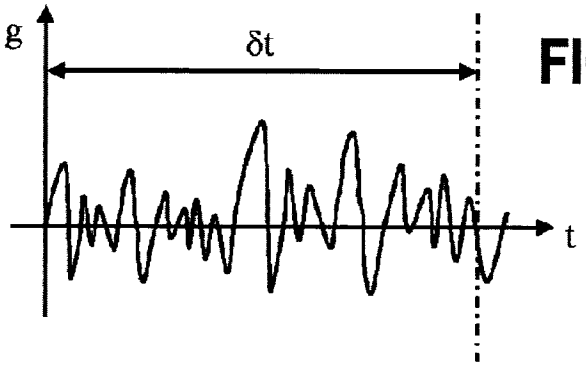
FIGS. 11A to 11D are diagrams relating to the acquisition and the processing of a signal by a fast Fourier transform (FFT) at different stages in the process of the invention.
Figure 11B:
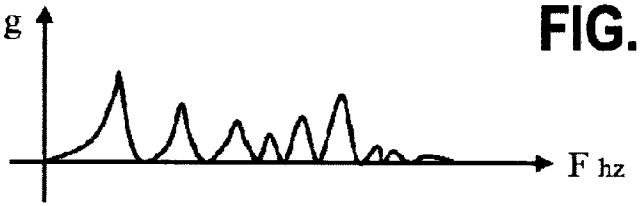
Figure 11C:
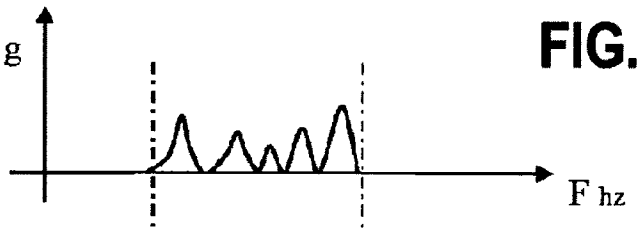
Figure 11D:
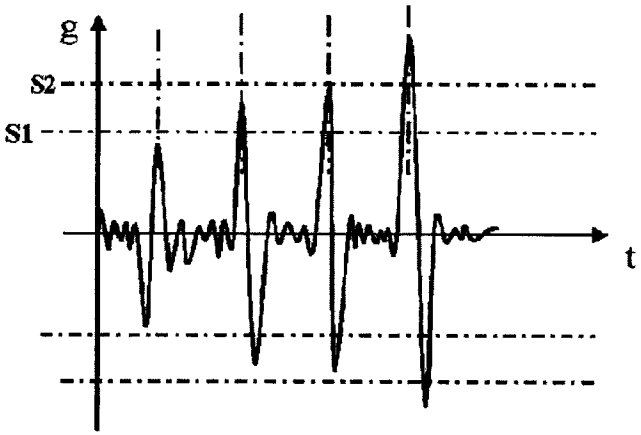

In FIGS. 11B and 11C, there can be seen the diagram of acceleration (g) as a function of frequency (Hz) corresponding respectively to processing the signal by means of an FFT (FIG. 11B) and after filtering out background noise (FIG. 11C). FIG. 11D is a diagram showing time acceleration after filtering and signal processing by means of an IFFT revealing when predefined thresholds S1, S2, etc., are exceeded.

On the basis of this FFT, a power spectral density (PSD) $=g^2/H_z$ is calculated in the manner known to the person skilled in the art in the field of signal processing. This calculation preferably applies to an impact type signal, where such a signal excites the entire structure of the ship including the substructure of the tank and the tank support, i.e. both locally and overall, resonating strongly about a frequency; the adjacent frequencies and their harmonics are also excited.

An energy spectral density (ESD)=$g^2 \times s/H_z$ type calculation of the kind known to the person skilled in the art of signal processing is preferable for a transient signal, whether short or long, since it makes estimation possible by using an averaging type process on the duration of the time signal selected for the FFT, e.g. over $\Delta t=2$ s, as shown in FIG. 11A.

Figure 12A:
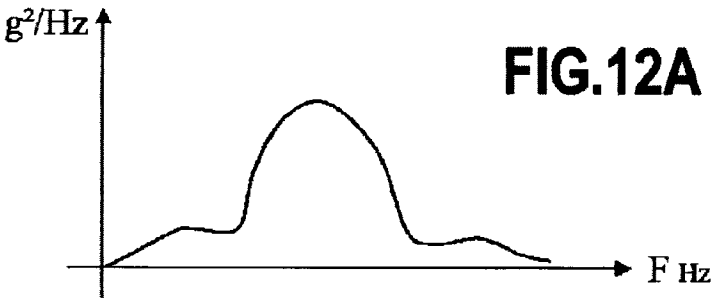
FIGS. 12A and 12B are diagrams of the signal being processed by a power spectral density (PSD) at different stages of the process of the invention.
Figure 12B:
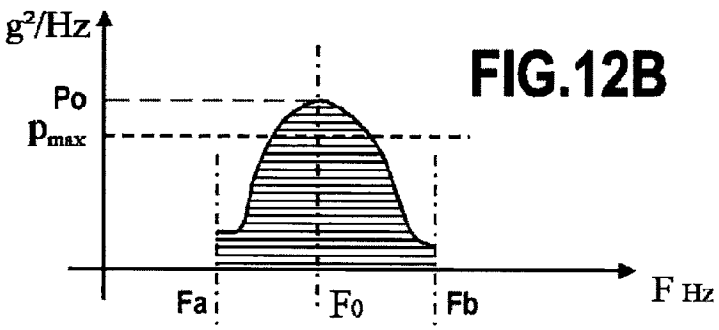

FIGS. 12A and 12B are graphs with the function $g^2$/Hz plotted up the ordinate and frequency Hz plotted along the abscissa, showing respectively the curve corresponding to processing the signal by means of a PSD (FIG. 12A), and after background noise filtering (FIG. 12B). Spectral power $g^2$ is then represented by the integral of the function $g^2$/Hz in FIG. 12B, i.e. by the area that is shaded in FIG. 12B, and that extends between the curve, the X axis, and the high and low filtering limits Fb and Fa.

Figure 13A:
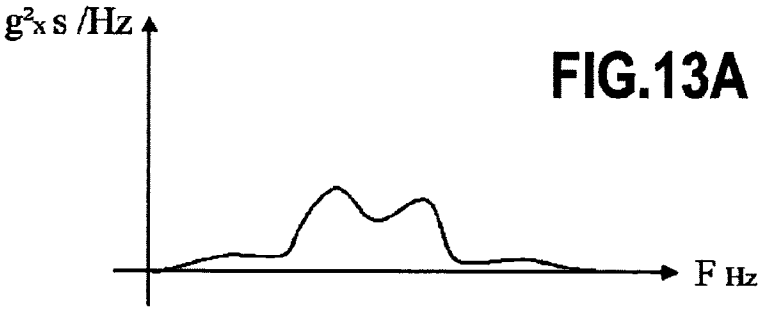
FIGS. 13A and 13B are diagrams of the signal being processed by an energy spectral density (ESD) at difference stages of the process of the invention.
Figure 13B:
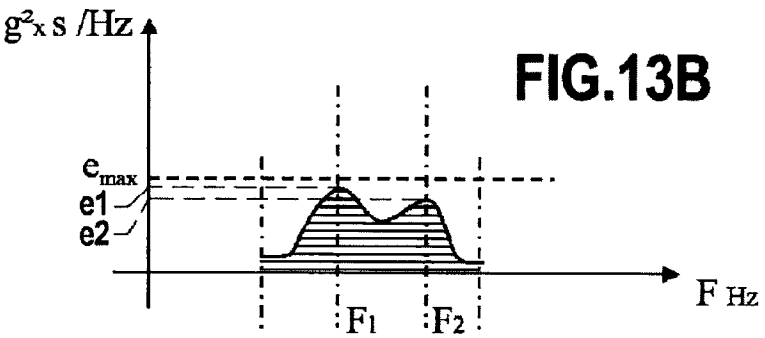

FIGS. 13A and 13B are graphs of ESD plotting $g^2$s/Hz up the ordinate, i.e. acceleration squared multiplied by time and divided by frequency, and plotting frequency Hz along the abscissa, the plotted curves corresponding respectively to the signal being processed by ESD (FIG. 13A) and after background noise filtering (FIG. 13B). The spectral energy ($g^2 \times t$) is then represented by the integral of the function $g^2$s/Hz shown in FIG. 13B, i.e. by the area that is shaded in FIG. 13B, extending between the curve, the X axis, and the high and low filtering limits.

After the signal has been processed within the calculation unit in the three modes described above, the resulting data is transmitted to the central supervisor 6 only in the event of maximum threshold values being exceeded.

With PSD giving a result as shown in FIG. 12B, the threshold for triggering transmission of data to the central supervisor 6 is defined as follows:

either by the curve exceeding the limit $p_{max}$; the transmitted data then has the value(s) of the power peak(s) $P_0$ associated with the corresponding frequency(ies) $F_0$, together with the overall spectral power as represented by the shaded area in said figure;

or else by the overall spectral power, as represented by the integral of the curve in FIG. 12B exceeding a given value, i.e. when the shaded area in said FIG. 12B exceeds a predefined threshold value, with the data that is transmitted then being the value of said overall spectral power, together, where appropriate, with the above-defined peak value(s) associated with the respective frequency(ies).

For ESD having the result shown in FIG. 13B, the threshold for triggering data transmission to the central supervisor 6 is defined as follows:

either by said curve exceeding a limit $e_{max}$; the data that is transmitted then being the value(s) of the energy peak(s) $e_1$, $e_2$ in association with the corresponding frequency(ies) $F_1$, $F_2$, together with the overall spectral energy as represented by the shaded area in said figure;

or else by the overall spectral energy as represented by the integral of the curve in FIG. 13B exceeding a given value, i.e. when the shaded area in said FIG. 13B exceeds a predefined threshold value; the data that is transmitted is then the value of said overall spectral energy together, where appropriate, with the value(s) of the above-defined peak(s) associated with the respective frequency(ies).

FIG. 12B shows a single peak of value $P_0$ exceeding the predefined threshold $p_{max}$.

FIG. 13B shows two energy peaks $e_1$ and $e_2$ neither of which exceeds the predefined threshold $e_{max}$, and consequently data transmission to the central supervisor 6 is not triggered by this signal relating to the peaks.

In the event of at least one predefined threshold being exceeded during the various kinds of processing applied to the time signal of FIG. 11A, as described above with reference to the FFT, the PSD, and the ESD, all or some of the results of the various kinds of processing, preferably all of the synchronous results of the three kinds of processing, are transmitted to the central supervisor 6 for concatenating with data coming from other sensors, within a mathematical model that represents the behavior of liquid free surfaces in the various LNG tanks of the ship.

By proceeding in this way, all real time calculation is performed by the calculation units 5*b* within the beacons 5, and only the result of the calculations are sent to the central supervisor 6, i.e. data that is compact and can be transmitted quickly, unlike a time signal which would then occupy the transmission medium full time regardless of whether it is of the radio type or of the local network type. Thus, a time signal having a duration $\delta t=2$ s would occupy the transmission medium for 100% of that time, whereas the results of the IFFT, PSD, and ESD are transmitted only if thresholds are exceed and over a duration of the order of 0.1 s to 0.5 s, thereby very quickly releasing the transmission medium, and drastically limiting the energy consumption of the beacons, since the main fraction of their energy consumption is drawn by said transmission means.

The calculation unit 5*b* continuously receives data from the sensor 5*a*, processes it continuously or discontinuously, stores it in its internal memory, and over time analyzes the overall behavior of the system, mainly when the ship is either sheltered or else navigating in calm water, i.e. without any risk of liquid free surfaces moving and thus sloshing. This observation correlated with the rolling and the pitching of the ship serves to evaluate the background noise that is specific to the ship in the absence of any significant movements of the liquid free surfaces, i.e. in the absence of any sloshing, and thus to define thresholds such as those described with reference to FIGS. 11D, 12B, and 13B, relating respectively to an IFFT, a PSD, and an ESD. Over time, these predefined thresholds are either adapted automatically within the calculation unit 5*a*, which operates in self-training mode after internally producing the results of the three above-described synchronous kinds of processing, or else modified by the central supervisor after overall processing over long periods, applied to information coming from all of the beacons, where such overall processing is correlated with the actual behavior of the ship and of its liquefied gas cargo.

[Translation of the French Abbreviations DSP and DSE to their English-Language Equivalents PSD and ESD.]

Signal filtering serves to eliminate parasitic frequencies, in general frequencies that are very low or very high. This filtering serves to eliminate so-called "background" noise, i.e. the noise that is created by the environment specific to the ship. A representation is thus obtained of the roughness of the liquid free surface within the tank, in particular in terms of energy spectral density, since the vibratory accelerations that are measured are associated with the masses of the moving liquid free surfaces within the tanks, and said energy spectral density is representative of the local roughness of the liquid free surface within the tank. This energy spectral density is then compared in real time with predetermined threshold values.

As soon as a predetermined threshold value is reached or exceeded, the calculation unit 5*b* performs an IFFT, thereby returning to the signals representing variation in acceleration g as a function of t, but nevertheless after eliminating said background noise during the above-mentioned filtering stages. Signals are thus made available in real time showing the variations of acceleration that are specific to the liquid free surface as a function of time and revealing any risk of potentially harmful sloshing occurring, together with the acceleration peaks that correspond to actual impacts against the walls of the tanks, or indeed to quasi-impacts, i.e. resonances that are growing and likely to lead in the very short term to impacts that are harmful for the integrity of the tank, and thus of the ship.

This information, once processed within the calculation unit 5*b* is transmitted, optionally at regular intervals, to the central supervisor 6 that then processes all of the data and specifies the location of the sloshing phenomenon in terms of tank number and the exact location of the roughness or the actual sloshing impacts, possibly also quantifying the amplitude of the phenomenon, where appropriate.

As shown in FIG. 11D, the calculation process within the calculation unit 5*b* advantageously defines a plurality of thresholds, e.g. two thresholds:

a first threshold S1 below which the information is transmitted on a routine basis at regular and widely spaced intervals, and above which the interval between two transmissions is shortened, e.g. halved, since there is then a risk of resonance phenomena occurring that might lead to harmful sloshing; and a second threshold S2 above which transmission is much more frequent, e.g. five times more frequent, and said beacon is then considered by the central supervisor 6 as having priority over the other beacons, so long as they have not also reached said threshold S2.

The mode of operation of the beacon as explained in detail above is based on the calculation unit self-training over time, said self-training having the effect of modifying certain parameters in the software incorporated in the calculation unit 5*b* over the course of time. These parameters are thus predefined when the installation is started on board the ship, and they vary over the course of time as a result of self-training, as a function of the overall behavior and of the results of analysis by the various beacons and by the central supervisor 6. The main parameters are thus set initially at conservative values, i.e. the thresholds are generally rather low, and they are then updated automatically over time to values that are more constraining and more realistic, as a function of the real behavior of liquid free surfaces as related to the behavior of the ship at that time. Thus, when the installation is started, e.g. the ship being in harbor or sailing at cruising speed on a calm sea, the analysis of the signals from the sensors 5*a* makes it possible very quickly and in various more or less calm situations, to characterize the background noise that is intrinsic to the system, and to eliminate it effectively when performing FFT type processing. The main parameters that are set initially but that are allowed to vary over time as a result of self-training, be that over a few days, and then a few weeks, a few months, a few years, include the following, amongst others:

the ranges of values for the roll periods of the ship (minimum value-maximum value) that run the risk of giving rise to large amounts of movement of liquid free surfaces, as a function of known filling levels of the tanks;

the frequency passband ranges (minimum value-maximum value) for filtering the signal, together with the predefined thresholds S1, S2, etc., when performing FFT and IFFT; and the energy or power spectral levels defined for PSD and ESP.

Together, these parameters in fact constitute a mathematical model of the overall behavior of the liquid free surfaces, and should the system lie within certain ranges of values, the risks of resonance leading to damaging sloshing might arise, whereas outside those ranges of values, any risk of resonance is minimal, or indeed quasi-impossible.

The beacons 5 represent considerable on-board calculation capacity, thereby enabling only the results of processed data to pass over the radio (wireless type beacons 5-1) or over the local network 5*d*-3 (wired beacons 5-2), thereby drastically reducing occupation of the central supervisor 6, which then serves only to concatenate the data that results from the signal processing in order to make deductions therefrom and to give the captain of the ship accurate information about the behavior of the cargo in each of the LNG storage tanks.

All of the beacons, whether of the wireless type 5-1 or of the wired type 5-2 are installed in an environment that contains gas, and they must therefore be of the anti-deflagration type, i.e. they must satisfy the so-called "ATEX" European standard. To do this, all of the elements constituting the beacons 5, i.e. the vibration sensors 5*a*, the calculation unit 5*b*, the means 5*c* for detecting movements of the ship, and the power supply 5*e* are confined within an enclosure 5-3 that satisfies the ATEX standard. Only some of the transmission means such as the radio antenna 5*d*-1, and the wired networks 5*d*-3, are not confined within the enclosure 5-3 as represented by dashed lines in FIGS. 7A and 7B.

The use of wired type beacons 5-2 requires a computer local network to be put into place and requires a power supply. However the local network 5*d*-3 is advantageously of the optical fiber type and power for a beacon is advantageously of the type including an incorporated battery 5*e*, just like the wireless beacons 5-1. Thus, installing the various components in such an ATEX environment is simplified correspondingly.

Advantageously, the electronic components of the calculation unit 5*b* used for signal processing and the components used for the transmission interface means 5*d*-2 in a wireless beacon 5-1 and for the interfaces 5*d*-4 in a wired beacon 5-2 are of the type presenting low consumption when in operation and very low consumption or even quasi-zero consumption when in a standby state. Thus, the energy that is to be supplied to the beacons can be provided by batteries 5*e* presenting a long lifetime and a long charge-retention time, and advantageously by lithium primary batteries that present a lifetime that exceeds two or three years. An assembly is thus made available that is capable of remaining in operation for several years, and all of the power supplies are advantageously replaced systematically on an occasion when the ship is inspected.

In a preferred version shown in FIGS. 4 and 4A, a wireless beacon is advantageously powered by a device 9 of the Seebeck effect thermocouple type that is installed inside the hull of the ship, between its side wall 4*b* and against the insulation wall 2*a*-1 of the tank. For this purpose, the beacon 5-1 is installed against the insulation wall 2*a*-1 of the tank, through which a small-diameter orifice 9*a* has previously been drilled, e.g. an orifice having a diameter of 5 millimeters (mm), passing right through to the primary or secondary ceiling wall 2, 2*f*, and then a thermocouple is inserted in the orifice so that its cold junction 9-2 is in contact with the internal cold wall 2, 2*f* which is at a temperature of −163° C. for the primary ceiling barrier. The cold junction 9-2 is connected in conventional manner by a two-strand cable to a hot junction situated level with the unit 9-3, which is at ambient temperature, i.e. at a temperature of 10° C. to 20° C. This temperature difference then generates electricity by the so-called "Seebeck" effect, suitable for continuously powering the beacon, and preferably for continuously recharging either a storage battery (not shown) or indeed a supercapacitor, i.e. a capacitor of very great capacitance. Thus, in the standby state, since power consumption is practically zero, battery or supercapacitor recharging takes place to a maximum extent, and as soon as the beacon starts to operate, the current produced is consumed in full in order to process the signal and also in order to transmit the data, with any additional demand being supplied by the storage element, specifically said battery or said supercapacitor. This arrangement presents the advantage of having operation that is extremely reliable and practically unlimited in time, without requiring any maintenance during the lifetime of the ship, naturally providing the electronic components have lifetimes that are comparable with the working lifetime of the ship, which may exceed 20 years to 30 years, or even more.

In the present invention, beacons are described of the wireless type 5-1 and of the wired type 5-2. Each of these two types presents its own advantages. Thus, with existing ships, the wireless version 5-1 presents a certain advantage, since the beacons are of the APEX type and each incorporates all of the required functions. They may be added to existing equipment and they may be secured to the deck or the inside of the hull, against the insulation wall, merely by means of adhesive, thus avoiding any work of the kind that is generally considered to be dangerous in potentially explosive environments.

The wired version 5-2 requires work to install a local network running all along the ship to the central supervisor 6 that is situated on the bridge. That type of arrangement is more particularly suitable for newly-built ships, even though the wireless version 5-1 still remains very advantageous under such circumstances, since it completely eliminates any need to deploy said local network **5*d*-3**, which represents a considerable expense, since such ships may measure several hundred meters in length. In this type of installation over very long distances, it is not unusual for the cost of the local network to constitute 70% to 85% of the cost of the overall installation. Thus, by using a set of wireless beacons, installation cost is reduced drastically, while also making installation easier and enabling it to be incorporated in a gas environment with a high risk of explosion that requires ATEX-standard equipment.

The ATEX standard is known to the person skilled in the art and the components used in the beacons 5-1, 5-2, and in particular in the sensor **5*a* and the calculation unit 5*b* are available in an ATEX module 5-3 from the supplier Cegelec (France) in its range of products having the reference SACC. The components 5*d*-2 performing radio transmission of data from the wireless beacon 5-1 are available, for example, from the supplier ASM (Austria) under the reference ASCell3911. Those components communicate over ISM standardized authorized frequencies of 868 megahertz (MHz), 433 MHz, and 315 MHz, thus complying with legislation in various industrialized countries. This type of component is of range limited to 25 m to 1000 m depending on the model and on the environment (confined medium or open medium) and presents power consumption when transmitting in the range 10 milliamps (mA) to 12 mA at 2 volts (V) to 3.5 V, with a standby consumption of the order of 0.5 microamps (μA), i.e. quasi-zero consumption, which represents a considerable advantage for the lifetime of storage batteries or lithium primary batteries providing the power supply. Components of this type are incorporated in the above-described ATEX module 5-3**.

For connections within the ship, when the beacons are installed between the side of the ship and the LNG tank, it is advantageous to install intermediate beacons having the sole role of receiving messages and relaying them further on. Thus, a message will reach all of the beacons and also the central supervisor 6 situated on the bridge of the ship, the messages passing from beacon to beacon.

In the description of the beacon, a mode of triggering said beacon by means of an inclinometer or an inertial unit **5*c* is described, however it is advantageous to use the main three-axis accelerometer 5*a* in order to perform this task, insofar as it presents sensitivity suitable for properly detecting the movements of the ship, as well as the thresholds for triggering said beacon. To this end, the calculation unit 5*b*** continuously scans the signals coming from said main accelerometer and deduces therefrom the actual movements of the ship and in particular its roll and/or pitching movements, thereby triggering, where appropriate, the above-described process of acquiring, processing, and transmitting data.

By way of example, on a methane tanker having a capacity of 135,000 $m^3$, made up as four LNG tanks, a wireless beacon is installed at each of the corners **2*c*, 2*d* of each of said tanks, said beacons being located on the deck 4*a***.

Each of the beacons is preadjusted to process the signals from the three-axis accelerometer **5*a* in a range of oscillation periods for liquid free surfaces that correspond to swells lying in the range 4-5 s to 15-18 s. The observation period δt associated with the FFT, as shown in FIG. 10**A, is then set at δt=2 s, corresponding to substantially two cycles of the FFT for short periods and up to nine cycles for long periods.

Thus, each of the beacons 5 is on continuous observation, i.e. it is continuously acquiring the movements of the ship (roll, pitching, . . . ), but it is on standby in terms of processing and transmission, i.e. its consumption is quasi-zero. As soon as the predefined trigger threshold is reached, e.g. roll of 8°, FFT calculations and other calculations concerning spectral energy are launched over the predefined observation period δt=2 s. Thereafter, each piece of data is compared with a reference by the calculation unit **5*b* after filtering in the manner explained above with reference to FIG. 10C. If the energy exceeds said energy reference, then an IFFT calculation is launched in order to reveal any quasi-impacts and impacts, and in order to classify their amplitude(s) relative to the predefined thresholds S1, S2, S3, etc. All of the calculations are performed very quickly by the calculation unit 5*b*, in a period of time that is much shorter than the roll period under consideration, and the results are stored within the calculation unit 5*b* in an associated memory. Where appropriate, the results are sent simultaneously to the supervisor 6 via the radio module or the local network 5*d*-3**. Within said supervisor, the results are concatenated with all of the synchronous or quasi-synchronous information coming from each of the other beacons installed on board the ship, thereby enabling the captain to be given a faithful representation of the roughness of the liquid free surfaces within each of the tanks on the ship.

The acquisition of data for each of the beacons is archived and processed internally. Over time, after several days, several weeks, several months of sailing of data acquisition, the various predefined thresholds are adjusted either up or down merely by self-training within the calculation unit **5*b*. Said adjustments are then transmitted at regular intervals of the supervisor 6 to ensure that all of the beacons present overall consistency. Where appropriate, the central supervisor 6 may take action on each of the beacons, merely by radio transmission, or where appropriate via the local network 5*d*-3**, in order to modify the predefined thresholds or indeed to modify the acquisition or self-training calculation programs. Similarly, said central supervisor takes action remotely to modify said defined reference thresholds. The modifications are also advantageously performed during maintenance operations on each of the beacons, or when a beacon is replaced by a new-generation beacon.

The device of the invention is particularly advantageous for old methane tankers that are being converted for use as a stationary floating storage unit, either close to the site where LNG is produced, or else in a coastal region as a reception and regasification terminal. These ships of old design often present performance in terms of tank installation that is less good or even damaged as a result of their years of operation that may reach and sometimes exceed 30 years or even 40 years. Furthermore, the propulsive means of ships of this type have also become obsolete given the poor efficiency of old engines, and the ships are due for ship-breaking even though the actual structure of the ship is still perfectly acceptable. Thus, converting such ships is most advantageous since the main engine is not used and the poor performance of the installation system is not critical and can under certain circumstances even be advantageous. This lack of performance in the installation system gives rise to a large amount of "boil-off", i.e. a large amount of LNG is classified by thermal losses, which is not a drawback in reception terminals but rather an advantage since the purpose of a terminal of this type is specifically to regasify the gas before sending it to land, or to transform it locally into electricity in electricity power stations. Furthermore, old methane tankers of this type are capable of sailing only when fully loaded or practically empty: they are not allowed to sail with an intermediate load since they do not present sufficient strength to withstand sloshing phenomena. When using old methane tankers in this way, the installation of devices of the invention for detecting liquid roughness makes it possible to acquire rapidly accurate knowledge about the behavior of the liquid free surfaces in various states of the sea and to define modes of operation that correspond to a high degree of operating safety, by managing the levels to which each of the tanks is filled as a function of knowledge about roughness relative to the filling level and the state of the sea at any given instant. Thus, after a preliminary operating period, the mathematical model is adjusted by self-training, and the critical filling levels for various sea states are then known. It is then easy to transfer LNG from one tank to another so that if potentially critical sea conditions occur, none of the tanks is at a corresponding critical filling level, thereby avoiding the appearance of undesirable sloshing phenomena.

The invention claimed is:

1. A ship or floating support for transporting or storing a liquid constituted by a liquefied gas, cooled in at least one tank having a width, said tank being thermally insulated and having at least said width greater than 20 m, and a volume greater than 10,000 $m^3$, said tank being supported inside a hull of a ship by a carrier structure, the ship having a plurality of beacons for detecting roughness of the liquid within said tank(s), each of said beacons comprising:

a) a vibratory accelerometer vibration sensor for measuring the amplitude of acceleration (g) as a function of time (t) of vibratory movements of a wall of said tank or of a wall of the ship that is not in contact with sea water, said wall of the ship including a deck of the ship or a wall of an internal structure of the ship, said vibration sensor being fastened on said wall outside said tank;

b) an electronic calculation unit having a microprocessor and an incorporated memory, for processing a signal as measured by said vibration sensor, to yield a processed signal, in order at least to eliminate background noise from said measured signal that is specific to the ship, and to detect movement of the liquid inside said tank by comparing values of the processed signal with predetermined threshold values beyond which the roughness of a liquid free surface is considered as constituting a risk of damaging deformation or deterioration of said wall; and c) a transmitter for transmitting said processed signal of the electronic calculation unit to a central unit.

2. The ship or floating support according to claim 1, wherein said vibration sensor is a piezo-resistive accelerometer.

3. The ship or floating support according to claim 1, wherein said transmitter comprises an antenna and a transceiver suitable for transforming said processed signal into radio waves.

4. The ship or floating support according to claim 1, wherein said transmitter comprises optical fiber cables and a signal processing interface for transforming said processed signal into light signals suitable for being conveyed via said optical fiber cables.

5. The ship or floating support according to claim 1, wherein said vibration sensor is constituted by a three-axis vibratory accelerometer.

6. The ship or floating support according to claim 1, wherein one of said beacons further includes an additional device suitable for detecting movements specific to the ship and for triggering activation by said beacons of all said electronic calculation units, said triggering of activation of said electronic calculation units taking place from a predetermined threshold value of an amplitude of said movements of the ship.

7. The ship or floating support according to claim 6, wherein said additional device suitable for detecting movements of the ship is a pendular inclinometer or an inertial unit-suitable for determining a roll angle of a side wall of a hull of the ship or floating support, said threshold value being a roll angle of at least 5° relative to vertical.

8. The ship or floating support according to claim 1, wherein said electronic calculation unit is suitable for being activated from a measurement of a threshold value for said amplitude of acceleration (g) as a function of time (t) of said vibratory movements.

9. The ship or floating support according to claim 1, wherein each said beacons is powered by a power supply consisting of a storage battery or a supercapacitor powering said vibratory accelerometer, and said electronic calculation unit.

10. The ship or floating support according to claim 9, wherein said power supply further includes a thermocouple in which a cold junction is installed between a cold internal wall of said tank and said beacon, said beacon constituting a hot junction of the thermocouple, said thermocouple serving to generate a current continuously for powering said beacon and continuously recharging said storage battery or supercapacitor.

11. The ship or floating support according to claim 1, wherein said beacons are secured to a deck of the ship and/or to a side wall of a system for supporting and insulating walls of said tank inside a hull of the ship facing a side wall of the hull, said beacons being situated in the corners of said tank at longitudinal ends of said tank.

12. The ship or floating support according to claim 11, wherein said beacons are positioned facing a dihedral angle formed by corners of said tank between a vertical longitudinal side wall, a vertical transverse wall, and a ceiling wall of said tank, or a trihedron formed by two planes of a ceiling wall of said tank that are disposed angularly relative to each other, and a transverse vertical side wall of said tank.

13. The ship or floating support according to claim 1, comprising a methane tanker transport ship converted into a floating storage ship that is anchored at a fixed location, in which a filling level of at least one tank is determined as a function of roughness of the liquid contained in said tank as detected and calculated by said beacons.

14. A method of detecting roughness of a liquid free surface within one or more tanks of a ship according to claim 6, the method comprises the following successive steps:

1) providing said measured amplitude of acceleration (g) as a function of time (t) of said vibratory movements of said wall with said vibration sensor;
2) triggering said activation of said electronic calculation unit when said the movement of the ship reaches a said predetermined threshold value;
3) performing said signal processing with said electronic calculation unit to yield said processed signal; and
2) transmitting values of said processed signal obtained in step 3) from said electronic calculation unit to said central unit.

15. The ship or floating support according to claim 1, wherein said liquefied gas is selected from methane, ethylene, propane and butane.

16. The ship or floating support according to claim 1, wherein said tank is a cylindrical tank having a polygonal cross section.

17. The method of claim 14, wherein in step 3) said electronic calculation unit performs the following signal-processing steps:

3.1) using a Fourier transform in real time to process a variation of said measured signal to calculate a variation in amplitude of acceleration (g) as a function of frequency (F) of a vibratory wave of said measured signal over a given period of time ($\Delta t$), and then calculating an energy spectral density and/or a power spectral density;

3.2) filtering the variation signal obtained in step 3.1) to eliminate therefrom the background noise due to vibration that is specific to the ship; then 3.3) calculating maximum time acceleration values obtained by an inverse Fourier transform of said variation in amplitude of acceleration (g) as a function of frequency (F) obtained in step 3.2), and calculating values of maximum energy spectral density ($e_1$, $e_2$) and/or of maximum power spectral density ($P_0$), respectively, of said energy spectral density and/or said power spectral density calculated in step 3.2); and 3.4) comparing said maximum time acceleration values and said maximum energy spectral density values ($e_1$, $e_2$) and/or said maximum power spectral density values ($P_0$) respectively of step 3.3) with respective predetermined threshold values ($S_1$, $e_{max}$, $p_{max}$) thereof from which roughness of said liquid free surface is considered as constituting a risk of damaging deformation or deterioration to said wall;

wherein in step 4), said electronic calculation unit transmits said maximum time acceleration values, said maximum energy spectral density values ($e_1$, $e_2$), and/or maximum power spectral density values ($P_0$), respectively, of step 3.3) to the central unit if said threshold value of step 3.4) is reached by at least one of said beacons.

* * * * *